US006412772B1

(12) United States Patent
Itoh et al.

(10) Patent No.: US 6,412,772 B1
(45) Date of Patent: Jul. 2, 2002

(54) CONTAINER FOR RECORDING MEDIUM

(75) Inventors: Taichi Itoh; Jun Kawai, both of Hirakata; Kazuhiro Tokuda; Michihiro Miyake, both of Asaka, all of (JP)

(73) Assignees: Matsushita Graphic Communication Systems, Inc.; Fuji Photo Film Co., Ltd., both of Tokyo (JP)

( * ) Notice: Subject to any disclaimer, the term of this patent is extended or adjusted under 35 U.S.C. 154(b) by 0 days.

(21) Appl. No.: 09/316,028

(22) Filed: May 21, 1999

(30) Foreign Application Priority Data

Aug. 4, 1998 (JP) ..... 10-220796

(51) Int. Cl.[7] ..... B65H 1/00

(52) U.S. Cl. ..... 271/145; 271/147; 271/160; 271/162; 271/164

(58) Field of Search ..... 271/145, 147, 271/160, 162, 164; 378/182; 206/455; 396/512, 517

(56) References Cited

U.S. PATENT DOCUMENTS 5,265,865 A * 11/1993 Agano et al. ..... 271/145 X
5,660,384 A * 8/1997 Kovach et al. ..... 271/145
5,879,003 A * 3/1999 Kovach et al. ..... 271/145 X
6,246,466 B1 * 6/2001 Hirano et al. ..... 271/145 X

FOREIGN PATENT DOCUMENTS

JP 61213169 9/1986
JP 1-271329 A * 10/1989 ..... 271/147
JP 2-276736 A * 11/1990 ..... 271/147
JP 3-272948 A * 12/1991 ..... 271/160

* cited by examiner

*Primary Examiner*—David H. Bollinger
(74) *Attorney, Agent, or Firm*—Greenblum & Bernstein, P.L.C.

(57) ABSTRACT

A cartridge comprises a shutter for opening and closing an opening portion formed on a ceiling plate of an upper side member. The shutter slides on an outer surface of the ceiling plate by attaching and detaching the cartridge. Lifter projections are projected on a back portion of a lifter provided in the cartridge. The lifter projections are projected to an outer section through an opening portion formed on a bottom plate of a lower side member. If the cartridge is put on the plane, the lifter projections are pressed to an interior, so that the lifter is pushed up. Thereby, a recording paper is pressed onto the back surface of the ceiling plate. As a result, a space of the cartridge is lessened, the flow of air from the outer section is reduced, and a variation in internal moisture is controlled.

15 Claims, 13 Drawing Sheets

CONTAINER FOR RECORDING MEDIUM

BACKGROUND OF THE INVENTION

1. Field of the Invention

The present invention relates to a container for a recording medium in which a recording medium, particularly thermo-sensitive and photosensitive recording medium is airtightly contained.

2. Description of the Related Art

As described in Publication of Unexamined Japanese Patent Application Sho-No. 61-213169, there is developed thermo-sensitive recording medium in which color forming layers of cyan, magenta, and yellow are laminated on a substrate. A micro capsule that contains color forming agent is dispersed in each color-forming layer. In this thermo-sensitive recording medium, chromophoric thermal energy differs, depending on each color-forming layer. Since thermal energy is thus made different from layer to layer, the color forming layer can be selectively color-formed. Then, to avoid performing the re-printing to an upper layer before the printing is executed to a lower layer after executing the printing to an upper layer, the following processing is executed. More specifically, the printed color layer is irradiated with light of a wavelength peculiar thereto, for example, ultraviolet rays, so as to carry out fixing processing. This processing is called a photofixing. A printing system using such the photosensitive recording medium is called a thermo-autochrom system.

Unlike the conventional sublimation-thermal transfer printing system, in the above thermo-autochrom system, since the recording medium itself color-forms, it is unnecessary to prepare the other ink ribbon, ink cartridge, etc. Also, a protection layer is formed on the uppermost layer, thereby developing resistance to influence from an outer section.

However, photofixed-recording medium (hereinafter referred to as simply recording medium) must be stored in a lightproof bag as being photosensitized. Also, such a recording medium requires careful handling when being set to a printer after being taking up.

Moreover, in the photofixed-recording medium, its property and the printing characteristic vary, depending on an amount of moisture contained in the recording medium (hereinafter referred to contained-moisture amount). For this reason, thermal sensitivity and image density to be obtained at a printing time differ, depending on an external environment before printing, particularly how much degree the photofixed-recording medium is exposed to a high or low moisture state. Moreover, this worsens conveyance in a printing apparatus.

To solve the above problem, there is a case in which the recording medium is contained in a closable cartridge to be isolated from light and moisture. However, there is needed an opening portion for which a transferring roller enters the interior to feed paper. In this case, air flows from the opening portion before and after the cartridge is attached to a printer, so that moisture of the interior varies and the shape of the recording medium changes. As a result, there is possibility that a predetermined print image may not be obtained.

In the cartridge for containing the stacked recording medium, the following processing is needed to reduce a variation in the contained-moisture amount of the recording medium:

(1) An area of the opening portion is extremely lessened to prevent air from entering from an outer section.

(2) An extra space of the cartridge is reduced to decrease an amount of air (amount of water vapor).

(3) The stacked recording medium is maintained to be adhered to each other to prevent air from entering the boundary surface between the recording medium.

Moreover, at the time of feeding paper from the cartridge, if the so-called overlap-feeding occurs, a part of recording paper that extends off the cartridge is exposed to air. This causes printing failure. Moreover, the contained-moisture amount of the corresponding extended part is varied and photosensitized by the overlap-feeding.

SUMMARY OF THE INVENTION

A first object of the present invention is to provide a container for a recording medium, which is capable of restraining a variation in a contained-moisture amount of the recording medium.

The above object can be achieved by a container for containing a recording medium having a containing body for containing a recording medium; a first opening portion, formed in said containing body, and having a size permitting the entry of a transferring roller; a second opening portion, formed in said containing body, through which said recording medium passes; and a shutter, attached to an outside of said containing body to be slidable, and covering at least said first opening portion.

The above object can be achieved by a container for containing a recording medium having: a containing body for containing a recording medium; and pressing means for pressing said recording medium onto an inner surface of said containing body at a printing apparatus attaching time and non-attaching time.

The above object can be achieved by a container for containing a recording medium comprising: a containing body for containing a recording medium; an opening portion, formed on said containing body, through which said recording medium passes; an inclined surface formed to be continuous to said opening portion; and a contact surface formed on said inclined surface, having an angle of inclination larger than that of the inclination surface, wherein said recording medium comes in contact with said contact surface.

BRIEF DESCRIPTION OF THE DRAWINGS

The above and other objects and features of the invention will appear more fully hereinafter from a consideration of the following description taken in connection with the accompanying drawing wherein one example is illustrated by way of example, in which.

DETAILED DESCRIPTION OF THE PREFERRED EMBODIMENTS

An embodiment of the present invention will be specifically described with reference to the accompanying drawings.

Figure 1:
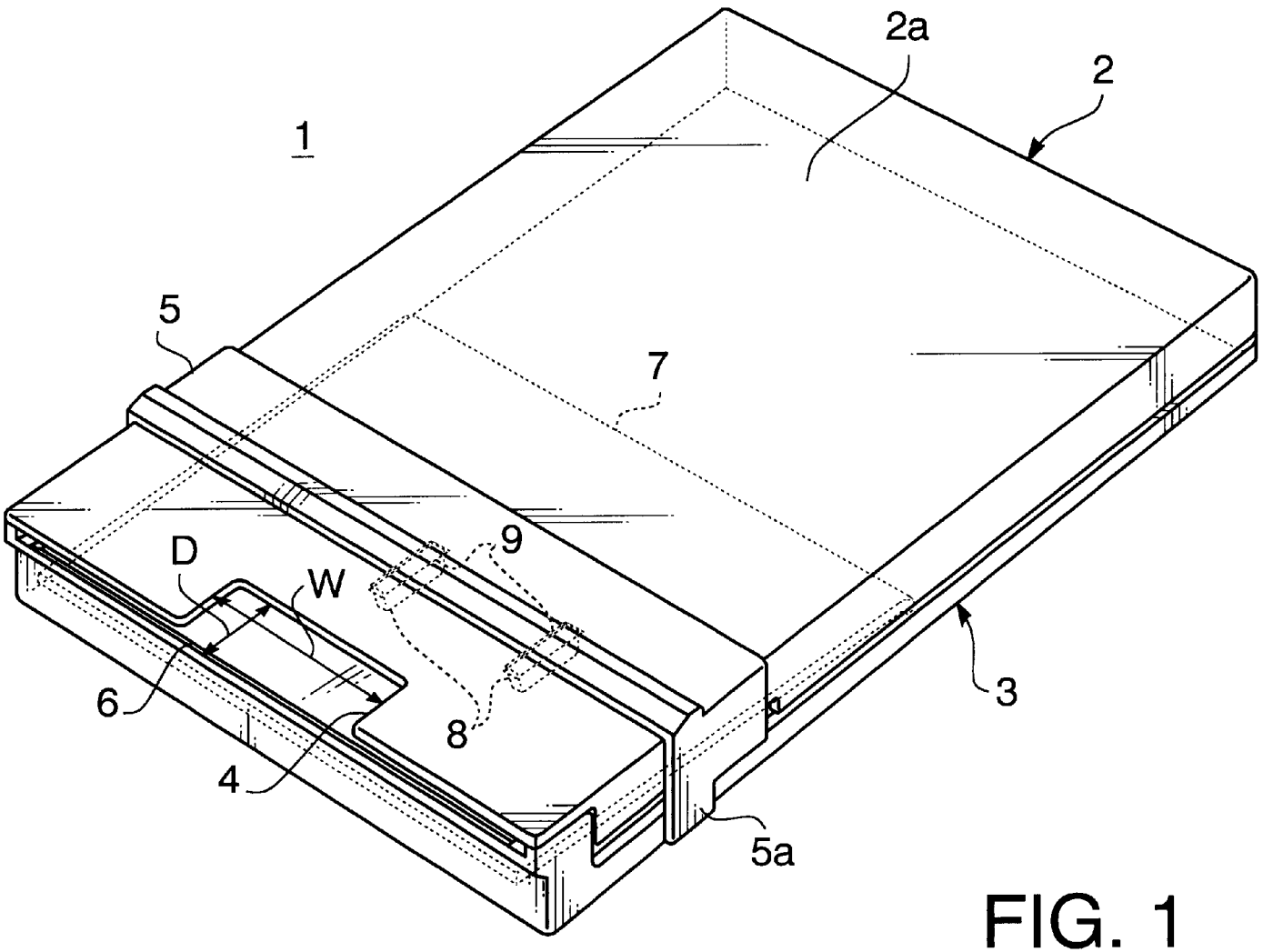
FIG. 1 is a schematic view showing a cartridge according to an embodiment of the present invention.

FIG. 1 is a schematic view showing a cartridge according to an embodiment of the present invention.

A cartridge 1 is a tightly closed housing having a pair of an upper side member 2 and a lower side member 3. The upper side member 2 and the lower side member 3 may be plastic moldings.

An opening portion 4 of the cartridge 1 is formed at substantially the center of a front end portion of a ceiling plate 2*a* of the side member 2. More specifically, the opening portion 4 is formed such that a part of the transferring roller enters the cartridge 1. A depth D of the opening portion 4 is set to a degree that a lowermost portion of the peripheral surface of the transferring roller can reach a contact position with photofixed-recording paper (hereinafter simply referred to as recording paper) of the cartridge 1. Also, the depth D is set to a degree that no trouble occurs in the rotation of the transferring roller. A width W of the opening poriton 4 is set to be slightly wider than that of the transferring roller not to interfere with the rotation of the transferring roller.

A shutter 5 that opens and closes the opening portion 4 is attached to be freely slidable on the upper surface of the ceiling plate 2*a*. Also, a slit 6 through which recording paper passes is formed on an upper end of a front end portion of the lower side member 3. A convex portion 5*a* is formed on the front end portion of the upper surface of the shutter 5 along the entire width.

A plate-like lifter 7 is attached to a bottom portion of the lower side member 3 to freely move up and down. Moreover, two lifter projections 8 are projected on a back portion of the lifter. An opening portion 9 is formed on a bottom portion of the lower side member 3 such that the lifter projections 8 are loosely inserted thereto.

In the cartridge 1, a plurality of recording paper is contained to be stacked on top of each other. The cartridge 1 has a light-shielding characteristic to a degree that the recording paper causes no photofixing. The cartridge 1 also has moisture-proof and low water permeability to a degree that a contained-moisture amount in the recording paper is unchanged. More specifically, it is preferable that the cartridge 1 should be formed of black plastic having a light-shielding characteristic and that the opening portion 4 thereof should be reduced to a minimum.

Figure 2:
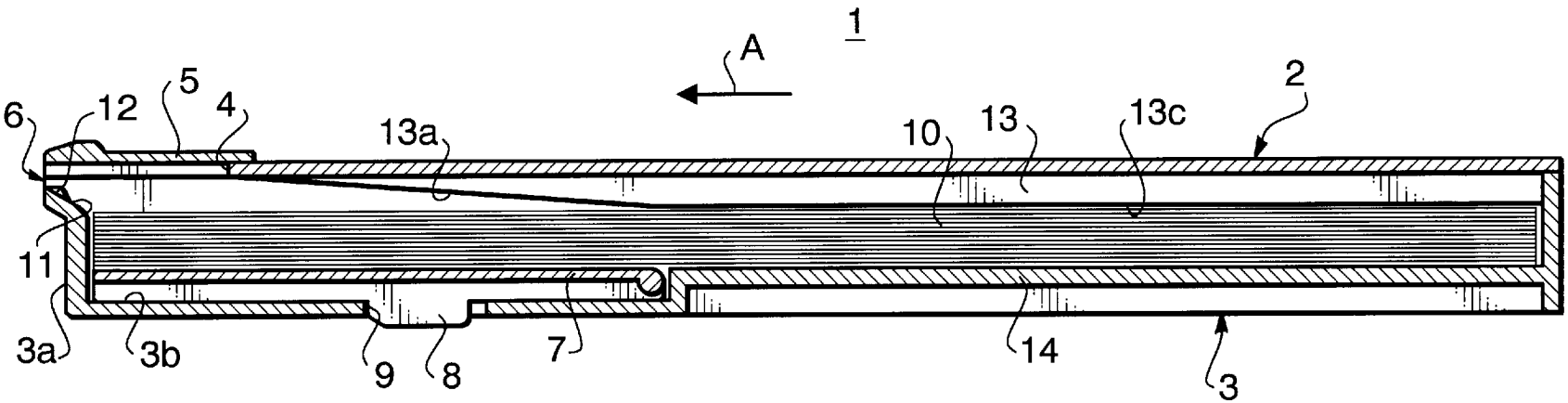
FIG. 2 is a vertical cross sectional view of the cartridge according to the embodiment.

FIG. 2 is a vertical cross sectional view of the cartridge according to the embodiment. An inclined surface 11 is formed on an upper side end portion of a front surface portion 3*a* of the lower side member 3 along the width direction of the recording paper. The height of the inclined surface 11 from a bottom surface 3*b* of the lower side member 3 is gradually increased from the inside of the cartridge 1 to the outside thereof. A projection 12 is formed on each of both side portions of the inclined surface 11.

A rib 13 is provided on an inner wall surface of the upper side member 2 along a recording paper transferring direction (arrow A) of the upper side member 2. An inclined portion 13*a* is formed in a predetermined area of the front side of the rib 13. A bottom-up portion 14, which is higher than the bottom surface 3*b*, is formed in an area of the lower side member 3, which is opposite to a back side area where no inclined portion 13*c* is formed.

Figure 3B:
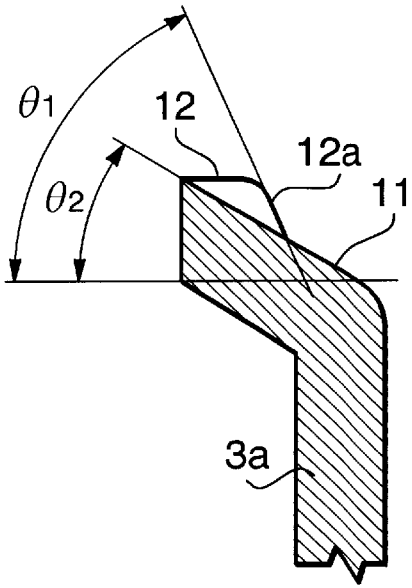
FIG. 3B is an enlarged view showing a portion in the vicinity of a projection of the cartridge according to the embodiment.
Figure 3A:
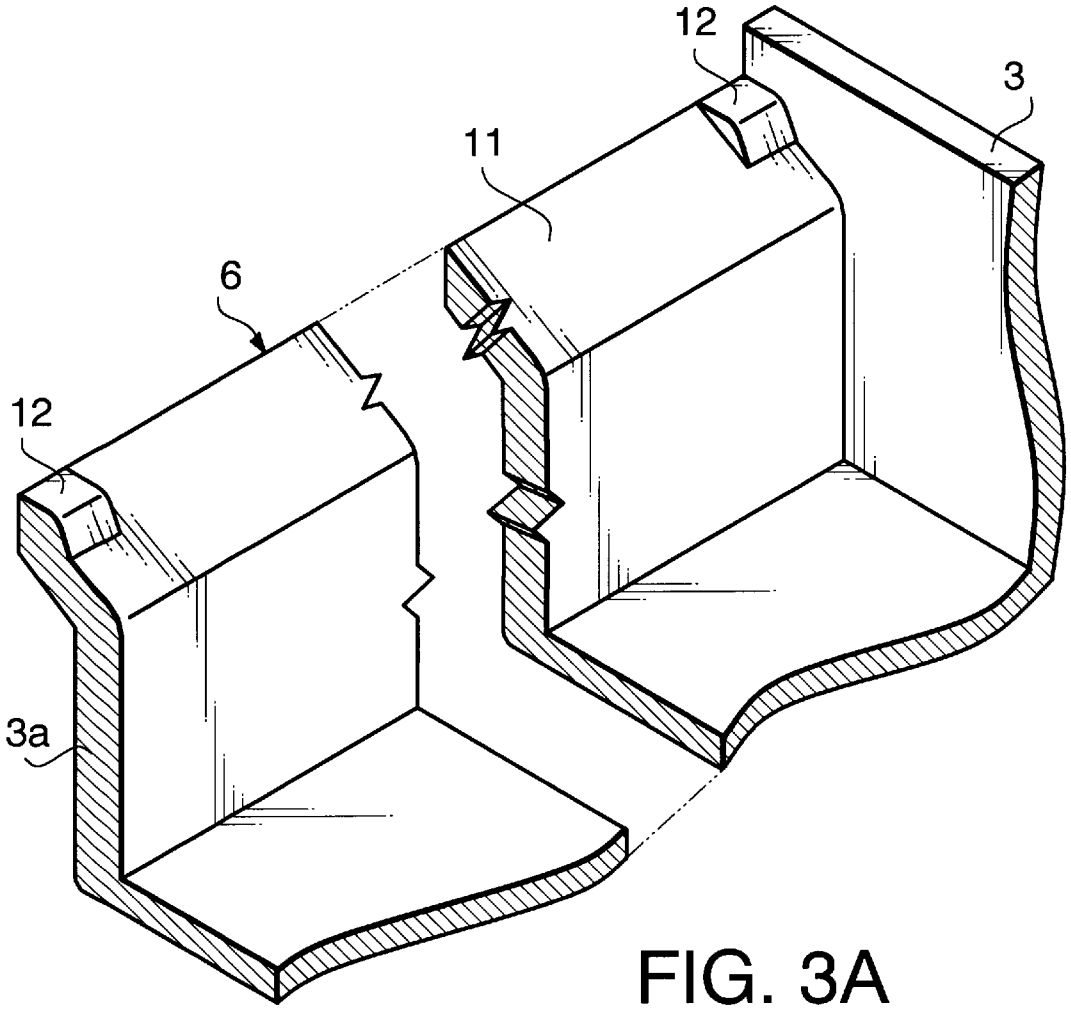
FIG. 3A is a perspective view showing a paper feeding section of the cartridge according to the embodiment.

FIG. 3A is a perspective view showing a paper feeding section of the cartridge 1 according to the embodiment. As is obvious from FIG. 3A, the projection 12 is formed on each of both end portions of the inclined surface 11. However, the projection 12 may be continuously formed along the entire surface of the inclined surface 11.

FIG. 3B is an enlarged view showing a portion in the vicinity of the projection 12 of the cartridge 1 according to the embodiment. As is obvious from FIG. 3B, an angle $\theta_1$ of inclination of the inclined surface 12*a* (hereinafter referred to as recording paper contact surface) of the projection 12 is larger than an angle $\theta_2$ of inclination of the inclined surface 11.

Figure 4:
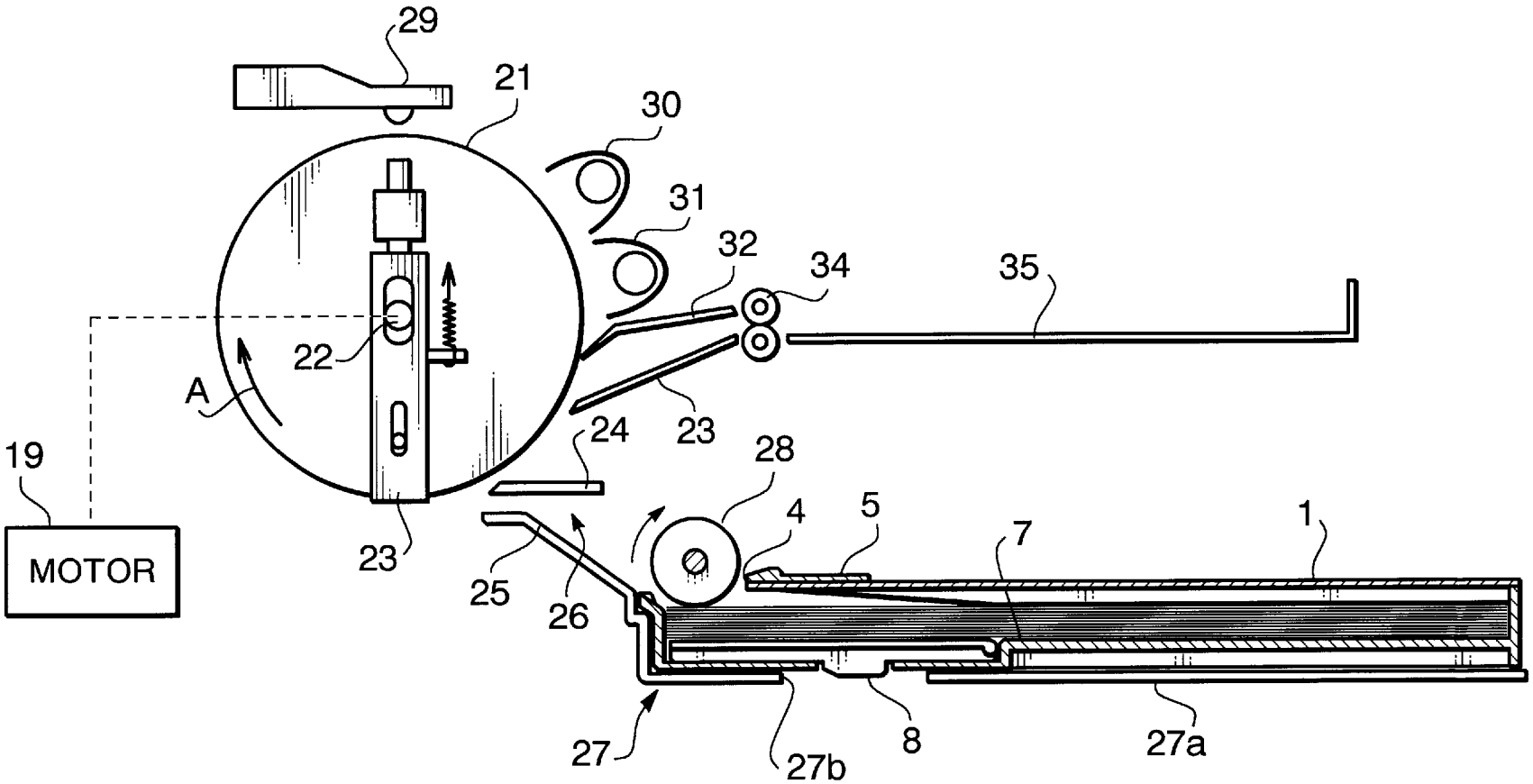
FIG. 4 is a schematic view showing a printer according to the embodiment.

FIG. 4 is a schematic view showing a printer 20 according to the embodiment. In FIG. 4, reference numeral 21 is a platen drum, which is substantially cylindrical and rotatable to a direction of an arrow A by a motor 19. A clamp member 23 is attached to a shaft 22 of the platen drum 21.

In the vicinity of the lowermost portion of the platen drum 21, guide plates 24 and 25 are arranged. The guide plates 24 and 25 form a paper feeding path 26. A cartridge containing section 27 where the cartridge 1 is set is formed at an entrance side of the paper feeding path 26. In the cartridge containing section 27, an opening portion 27*b* is formed on a bottom plate 27*a* that supports the cartridge 1.

Moreover, a transferring roller 28 is provided at a position where the shutter 5 can enter a slightly inner side than the opening portion 4 in an opened state at the time of attaching the cartridge 1.

A thermal head 29, a photofixing unit 30 for yellow and a photofixing unit 31 for magenta are sequentially arranged along the rotational direction of the platen drum 21. At the back stage of the photofixing unit 31 for magenta, a separation claw 32 and a discharge guide plate 33 are provided. A pair of transferring rollers 34 is provided in the direction of the separation claw 32 and the discharge direction of the discharge guide plate 33. A tray 35 is provided at a discharge side of the pair of the transferring rollers 34.

Figure 5:
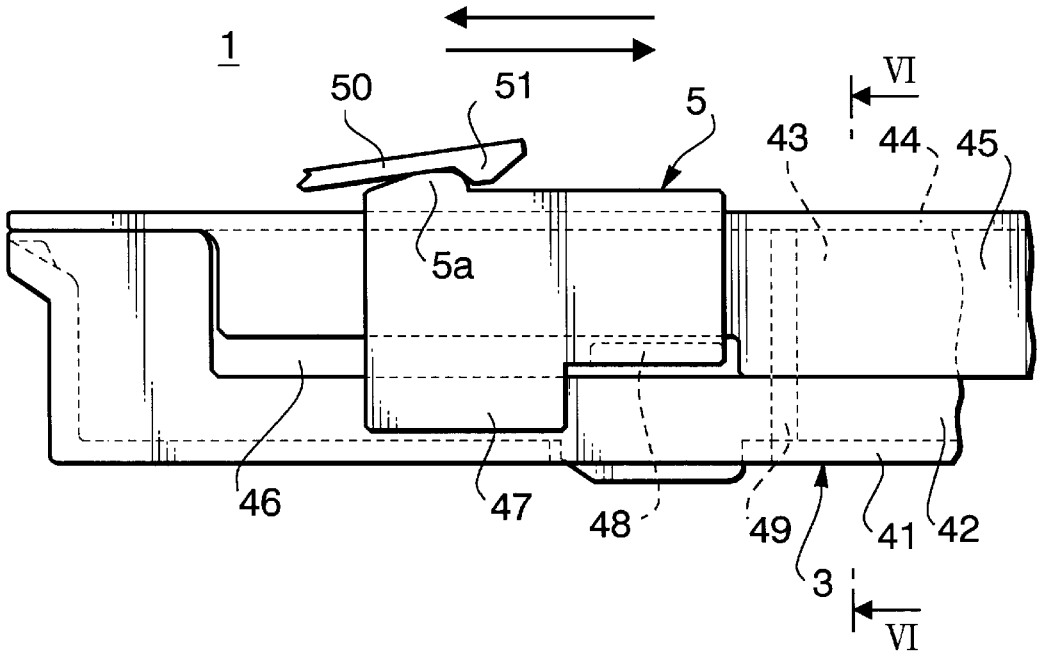
FIG. 5 is a side view showing an operation state of a shutter of the cartridge according to the embodiment.
Figure 6:
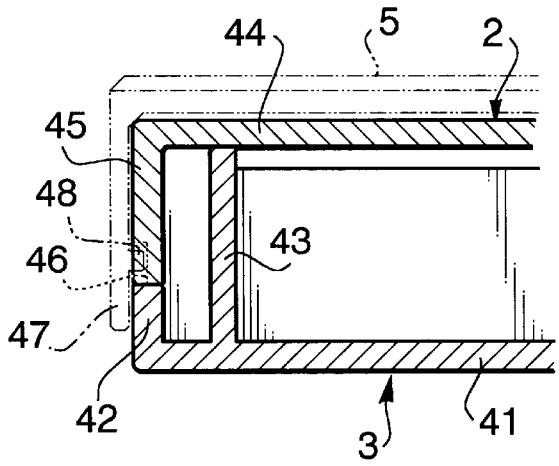
FIG. 6 is a vertical cross sectional view taken substantially along the lines VI—VI of FIG. 5.

FIG. 5 is a side view showing an operation state of the shutter 5 of the cartridge 1 according to the embodiment. FIG. 6 is a vertical cross sectional view taken substantially along the lines VI—VI of FIG. 5.

In the lower side member 3 of the cartridge 1, an outer wall 42 is uprightly formed along an outer edge of a plate-like bottom plate 41. Also, at both side edge portions of the bottom plate 41, an inner wall 43 is uprightly formed along a slightly inner side than the outer wall 42. The inner wall 43 comes in contact with a back face of a ceiling plate 44 of the upper side member 2. The height of the outer wall 42 at the portion facing to the inner wall 43 is lower than that of the inner wall 43, specifically about ⅓ to ½ of the inner wall 43. An outer wall 45 is formed along both side edge portions of the ceiling plate 44. An end surface of the outer wall 45 comes in contact with that of the outer wall 42 of the lower side member 3. A contact portions between the inner wall 43 and the ceiling plate 44 and that of the contact portion between the outer wall 42 and the outer wall 45 can be bonded by adhesion or fusion to improve the air-tightness of the contact portions.

In the outer wall 45 of the upper side member 2, a range where the shutter 5 slides is notched, and a guide rail 46 is formed between the outer wall 45 of the upper side member 2 and the outer wall 42 of the lower side member 3. A guide 48, which is formed at the lower end portion of both side wall portions 47 of the shutter 5, is engaged with the guide rail 46 so as to restrict the moving direction of the shutter 5 and to prevent the detachment of the shutter 5. Moreover, a partition wall 49 is formed along the vertical direction of the inner wall 43 of the lower side member 3 to interrupt the flow of air from the guide rail 46.

Next, the following will explain a case in which the above-structured cartridge 1 is attached to the cartridge containing section 27. In the cartridge containing section 27, two hooks 50 are fixed to the printer shown in the FIG. 4 at a slightly higher position with respective to both side edge portions of the upper side member 2 of the cartridge 1. A projection 51 is formed at the lower surface side of each hook 50.

If the cartridge 1 is inserted to the cartridge containing section 27, the convex portion 5*a* of the shutter 5 comes in contact with the projection 51 of the hook 50 so that the shutter 5 slides. If the shutter 5 slides up to the limit, the projection 51 mounts over the convex portion 5*a*. When the cartridge 1 is detached therefrom, the shutter 5 slides forward since the convex portion 5*a* and the projection 51 are engaged with each other. If the shutter 5 slides up to the limit, the projection 51 is detached from the convex 5*a*. Thereby, the shutter 5 is opened and closed by attaching and detaching the cartridge 1.

The cartridge 1 according to the embodiment has a double structure in which the outer walls 42, 45 and the inner wall 43 are provided. This prevents air and water from coming into the cartridge easily. Particularly, in the present embodiment, the contact portions between the outer wall 45 of the upper side member 2 and the outer wall 42 of the lower side member 3 and the contact portion between the inner wall 43 of the lower side member 3 and the inner surface of the ceiling plate 44 of the upper side member 2 are different from each other in the height, and they are formed in a staggered configuration. As a result, a water incoming path extending from the outer section to the inner section becomes long. Then, even if water enters from the contact portion on the outer wall side, it takes much time for water to reach the inner side of the inner wall 43, with the result that resistant to moisture is improved.

The above-structured cartridge 1 comprises the upper side member 2, which has the opening portion 4 on only the portion of the paper feeding paper 28 and the outer shutter, which slides the outer side of the cartridge 1. For this reason, as compared with the shutter, which slides the inner side, (hereinafter referred to as an inner shutter), the following advantages can be obtained in connection with the improvement of resistant to moisture of the cartridge.

Figure 7A:
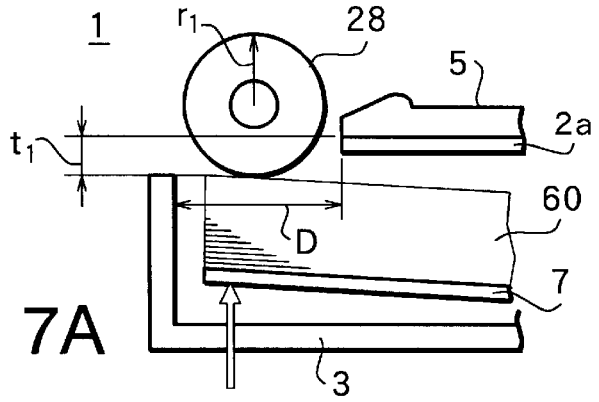
FIG. 7A is a partial cross sectional view showing the relationship between a transferring roller and an opening portion in a case of an outer shutter according to the embodiment.
Figure 7B:
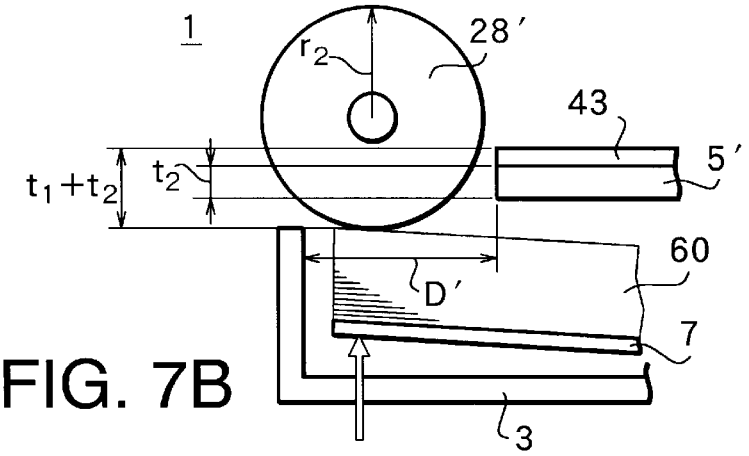
FIG. 7B is a partial cross sectional view showing the relationship between the transferring roller and the opening portion in a case of an inner shutter as a comparison.

First, the diameter of a transferring roller 28 can be reduced. FIG. 7A is a partial cross sectional view showing the relationship between the transferring roller and the opening portion in a case of the outer shutter according to the embodiment. FIG. 7B is a partial cross sectional view showing the relationship between the transferring roller and the opening portion in a case of the inner shutter as a comparison. As shown in FIG. 7A, in the case of the outer shutter 5, if the peripheral surface of the transferring roller 28 is placed at a position (depth t1), which is slightly deeper than the thickness of the ceiling plate 2*a* of the upper side member 2, the transferring roller 28 can come in contact with the recording paper. In contrast, as shown in FIG. 7B, in the case of an outer shutter 5', the position where a transferring roller 28' comes in contact with the recording paper becomes deeper by a thickness (t2) of an inner shutter 5'. For this reason, a radius (r2) of the transferring roller 28' must be larger than the radius (r1) of the transferring roller 28 shown in FIG. 7A. Thus, according to the cartridge 1 of this embodiment, the diameter of the transferring roller 28 can be decreased. Thereby, cost saving of the printer and reduction of the height of the printer can be archived reductions in cost and size of the apparatus. Also, the depth D of the opening portion 4 can be reduced.

Figure 8A:
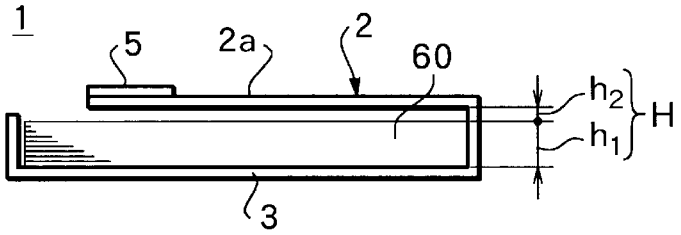
FIG. 8A is a partial cross sectional view showing the cartridge in the case of the outer shutter according to the embodiment.
Figure 8B:
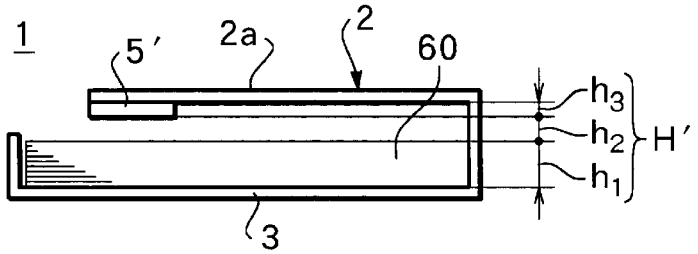
FIG. 8B is a partial cross sectional view showing the cartridge in the case of the inner shutter as a comparison.

Second, an extra space of the cartridge 1 can be decreased. FIG. 8A is a partial cross sectional view showing the cartridge in the case of the outer shutter according to the embodiment. FIG. 8B is a partial cross sectional view showing the cartridge in the case of the inner shutter as a comparison. In the case of the outer shutter, as shown in FIG. 8A, since the shutter 5 slides on the outside of the cartridge 1, it is unnecessary to provide the space in the cartridge 1. While, in the case of the inner shutter, as shown in FIG. 8B, the space for which the shutter 5' slides in the cartridge 1' is needed. As a result, air flows into the space so that moisture of the recording paper is varied.

Moreover, in the case of the outer shutter, as shown in FIG. 8A, a height H of the interior of the cartridge 1 includes a height h1 of recording paper 60 and a height h2 for some clearance. While, in the case of the inner shutter, as shown in FIG. 8B, a height H' of the interior of the cartridge 1' becomes higher than height H by a height h3 of the shutter 5'. Thus, in the case of the outer shutter, since the space where air flows into the cartridge 1 can be reduced, the variation in the moisture of the recording paper can be restrained, and preservation of the recording paper can be improved. Moreover, since the height of the cartridge 1 can be decreased, the reduction in the thickness of the cartridge 1 can be archived. Also, the height of the printer can be reduced.

Figure 9A:
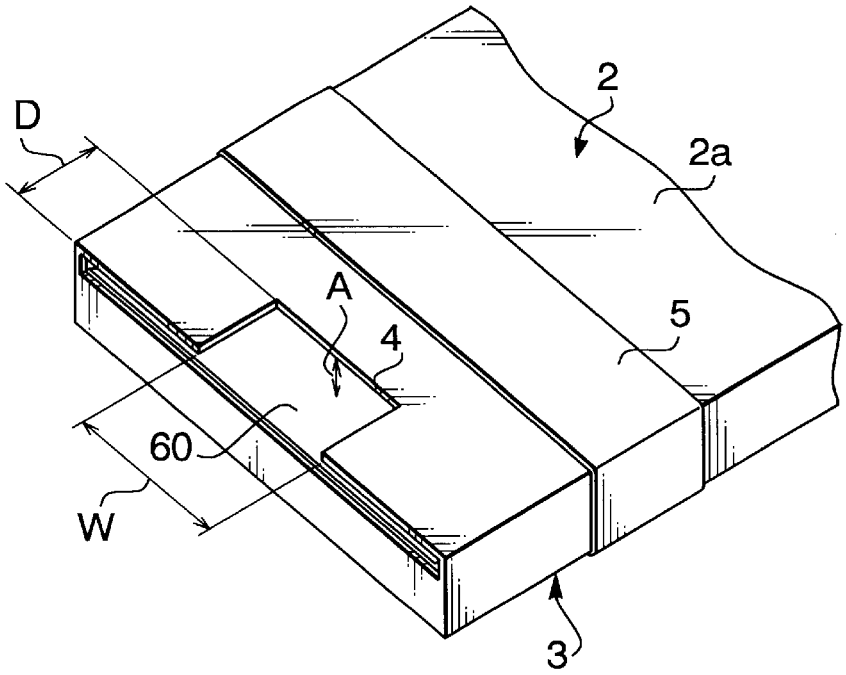
FIG. 9A is a perspective view showing the portion in the vicinity of the opening portion of the cartridge in the case of the outer shutter according to the embodiment.
Figure 9B:
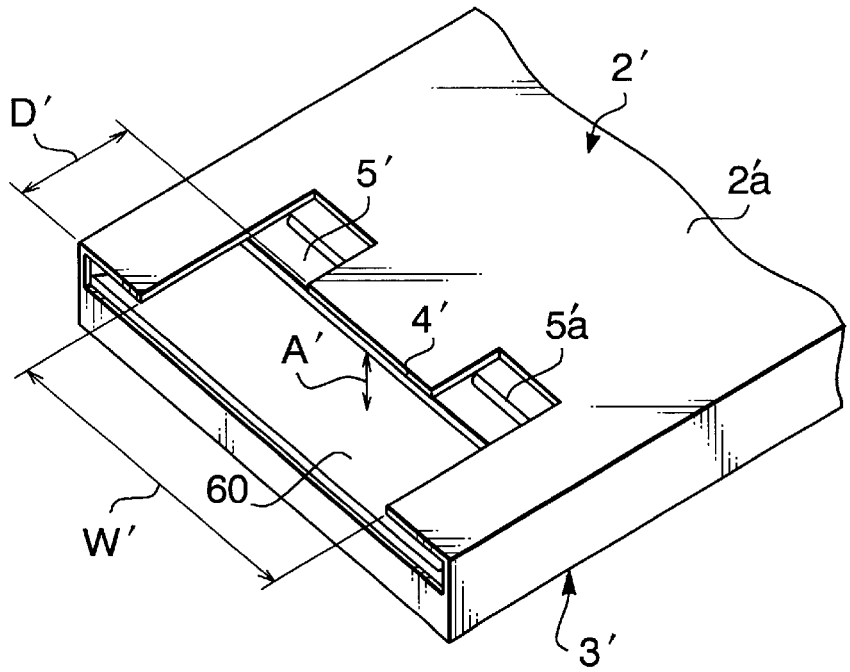
FIG. 9B is a perspective view showing the portion in the vicinity of the opening portion of the cartridge in the case of the inner shutter as a comparison.

Third, it is possible to reduce the volumetric capacity of the opening portion at the time of opening the shutter. FIG. 9A is a perspective view showing the portion in the vicinity of the opening portion of the cartridge in the case of the outer shutter according to the embodiment. FIG. 9B is a perspective view showing the portion in the vicinity of the opening portion of the cartridge in the case of the inner shutter as a comparison. The depth of the opening portion depends on the diameter of the transferring roller. In other words, the depth is determined not to prevent the rotation of the transferring roller. As shown in FIG. 9A, in the case of the outer shutter, since the diameter of the transferring roller 28 can be reduced, the depth D can be also reduced. However, in the case of the inner shutter, as shown in FIG. 9B, since the diameter of the transferring roller 28' is large, the depth of the opening portion becomes larger than the depth D'.

Next, regarding the width of the opening portion, in the case of the outer shutter, if the width of the transferring roller 28 is permitted, the width W of the opening portion may be sufficient. However, in the case of the inner shutter, a width for permitting a shutter slide mechanism, which contacts the projection 5' a of the shutter 5', is generally needed to open and close the shutter 5' in addition to the width of the transferring roller 28'. For this reason, in the case of the inner shutter, the width W' of the opening portion is larger than the width W of the outer shutter.

In the state that the cartridge 1 is attached to the printer, the recording paper 60 in the cartridge 1 is moved upward by a load imposed by the lifter 7 so as to be brought into contact with the transferring roller 28. In the case of the outer shutter, the upper surface of the recording paper 60 is positioned at the portion in the vicinity of the lower surface of the ceiling plate 2*a* of the upper side member 2. For this reason, the distance between the ceiling plate 2*a* at the opening portion 4 and the recording paper 60, that is, height A of the opening portion 4 from the recording paper 60 is relatively small. On the other hand, height A' of the opening portion 4' includes the thickness of the shutter 5' as shown in FIG. 7B. Therefore, height A' is higher than height A.

As mentioned above, in the case of the outer shutter, the volumetric capacity of the opening portion can be reduced as compared with the inner shutter. For this reason, the amount of water incoming from the outer section can be decreased, the variation in the moisture of the recording paper can be restrained, and preservation of the recording paper can be improved.

Fourth, since the recording paper and the shutter 5 do not contact each other, the opening and closing of the shutter 5 are stabilized, and there is no need of providing the clearance for preventing the contact therebetween in the cartridge. For this reason, the cartridge can be more thinned. Also, the extra space of the cartridge is reduced and the amount of air of the cartridge is reduced, so that the variation in moisture of the recording paper can be decreased.

Fifth, the shutter 5 is fixed onto the ceiling plate 2*a* of the upper side member 2. For this reason, since the shutter 5 is supported by the ceiling plate 2*a*, the shutter 5 is not easily deformed even if an external force is added to the shutter 5. This prevents trouble from being generated by the deformation of the shutter 5, and the shutter 5 can be thinned.

Sixth, the opening and closing of the shutter 5 can be realized by forming the convex portion 5*a* on the shutter 5 and the hook 50 on the printer as shown in the embodiment. This eliminates the need for the provision of complicated mechanism in the printer.

Since the cartridge 1 according to the embodiment comprises the inclined surface 11 and the projection 12 on the discharging section of the recording paper, occurrence of overlap-feeding of the recording paper can be prevented. FIGS. 10 to 13 are side cross sectional views each showing a paper feeding state of the cartridge according to the embodiment.

Figure 10:
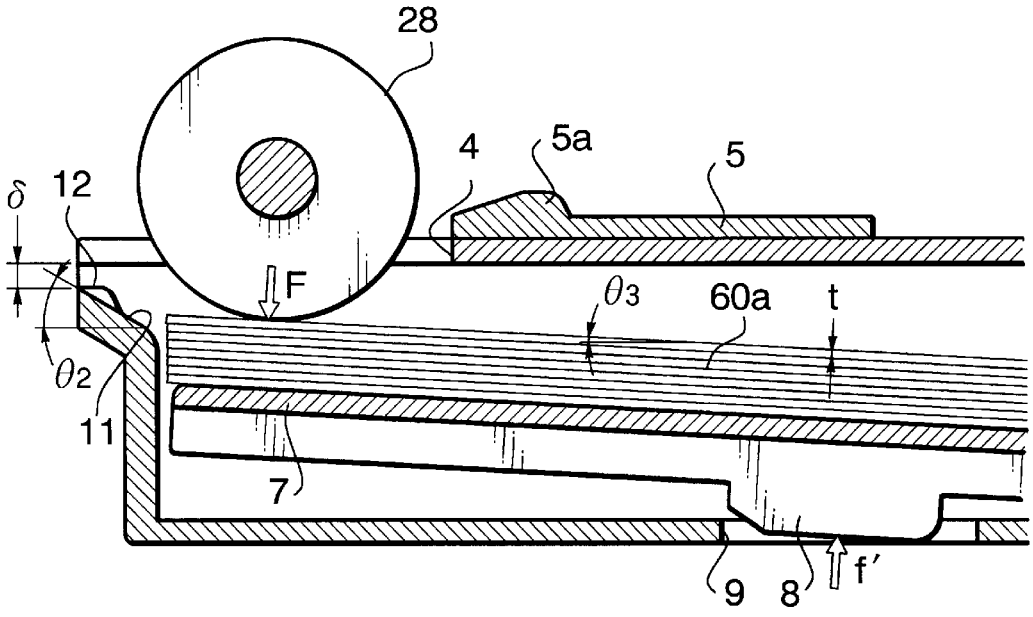
FIG. 10 is a side cross sectional view showing a paper feeding state of the cartridge according to the embodiment.

As shown in FIG. 10, when the cartridge 1 is attached to the cartridge containing section 27, the shutter 5 is opened and the part of the transferring roller 28 enters the opening portion 4. On the other hand, the lifter projections 8 of the lifter 7 are pushed up by push-up means as described later. As a result, the top end portion of an uppermost recording paper 60*a* and the peripheral surface of the transferring roller 28 are brought into contact with each other.

Figure 11:
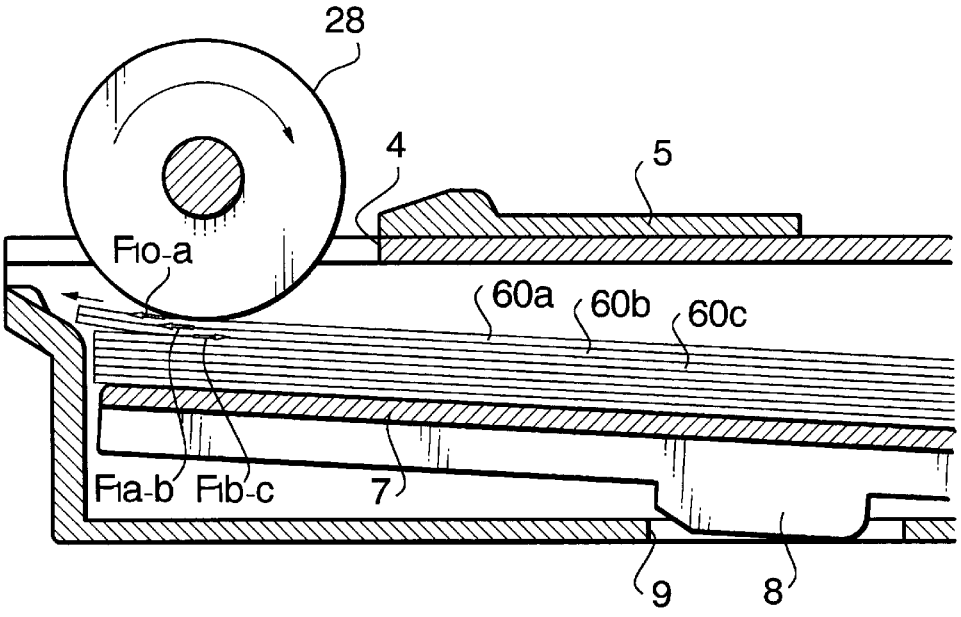
FIG. 11 is a side cross sectional view showing a paper feeding state of the cartridge according to the embodiment.

As shown in FIG. 11, when the transferring roller 29 rotates, a frictional force $F_{10\text{-}a}$ is applied between the first recording paper 60*a* and the transferring roller 28. Also, a frictional force $F_{1a\text{-}b}$ is applied between the first recording paper 60*a* and a second recording paper 60*b*. A frictional force $F_{1b\text{-}c}$ between the second recording paper 60*b* and a third recording paper 60*c* acts on a direction opposite to the transferring direction. Therefore, in a case of $F_{1a\text{-}b}>F_{1b\text{-}c}$, the second recording paper 60*b* moves forward in accordance with the advancement of the first recording paper 60*a*.

Figure 12:
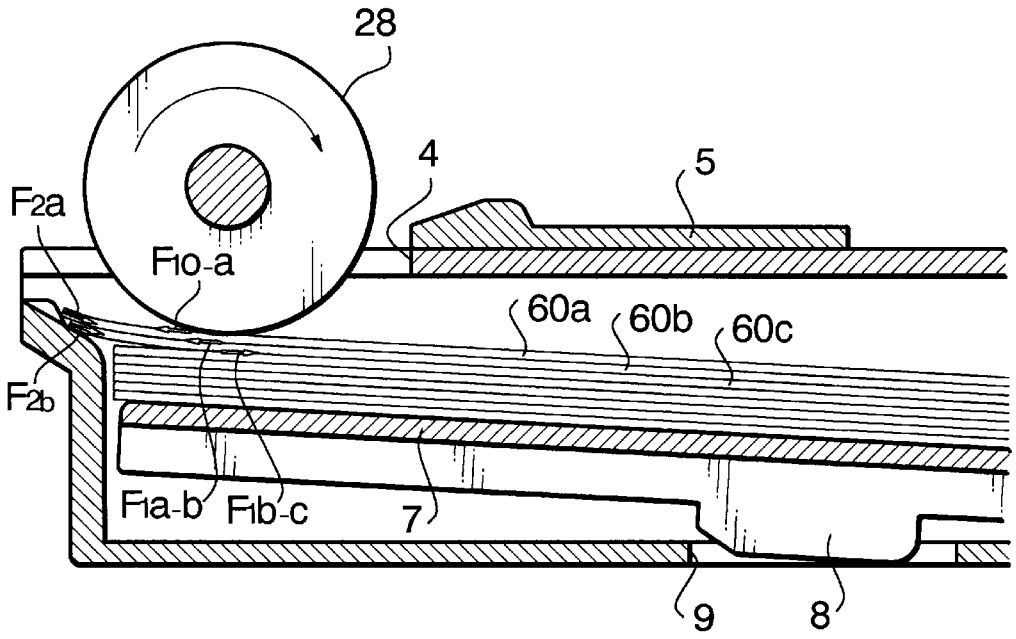
FIG. 12 is a side cross sectional view showing a paper feeding state of the cartridge according to the embodiment.
Figure 13:
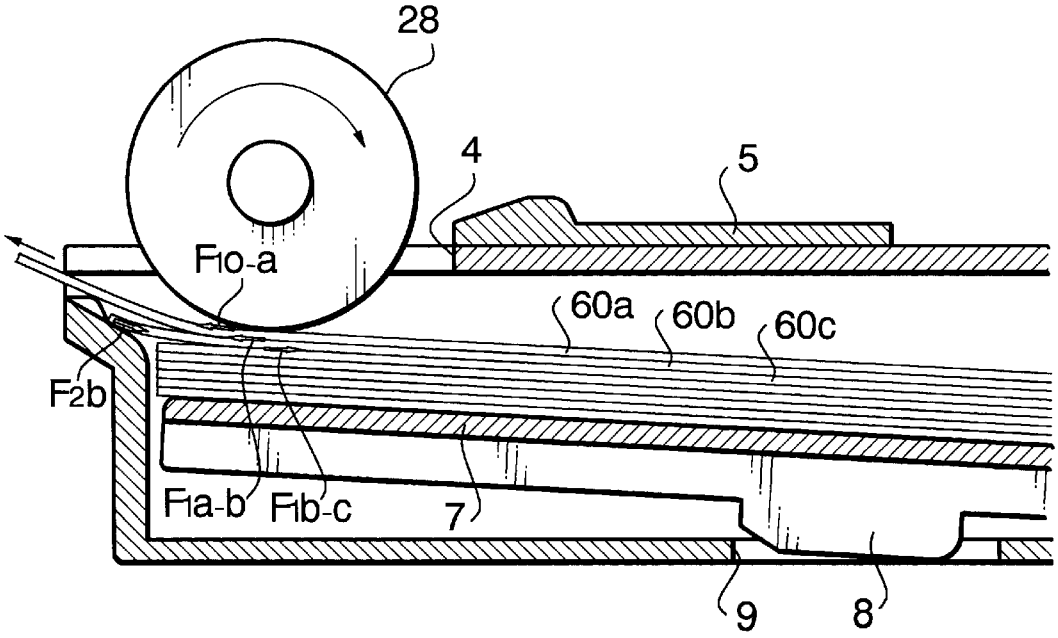
FIG. 13 is a side cross sectional view showing a paper feeding state of the cartridge according to the embodiment.

As shown in FIG. 12, when the end surfaces of the advanced recording paper 60*a*, 60*b* come in contact with the recording paper contact surface 12*a* of the projection 12, reaction forces $F_{2a}$, $F_{2b}$ act on the recording paper 60*a*, 60*b*, respectively. The frictional force $F_{10\text{-}a}$ by which the first recording paper 60*a* is advanced is generated by the transferring roller 28. For this reason, the frictional force $F_{10\text{-}a}$ is much larger than the reaction force $F_{2a}$. As shown in FIG. 9, the first recording paper 60*a* mounts over the projection 12 and advances. On the other hand, the frictional force by which the second recording paper 60*b* is advanced is generated by the frictional force between the first and second recording paper 60*a* and 60*b*. For this reason, the frictional force $F_{1a\text{-}b}$ is relatively low. As shown in FIG. 13, the second recording paper 60*b* cannot mount over the projection 12, and stops. As a result, occurrence of overlap-feeding of the recording paper can be prevented.

Also, by the provision of the projection 12 is formed in the cartridge 1, the top end of the second recording paper 60*b* is not exposed from the cartridge 1. Moreover, the top end of the recording paper 60*b* is not exposed even in a case where the cartridge 1 is taken up to the outer section of the printer when the shutter 5 is closed. This makes it possible to maintain moisture-proof and light-proof characteristics against the recording paper.

Figure 14A:
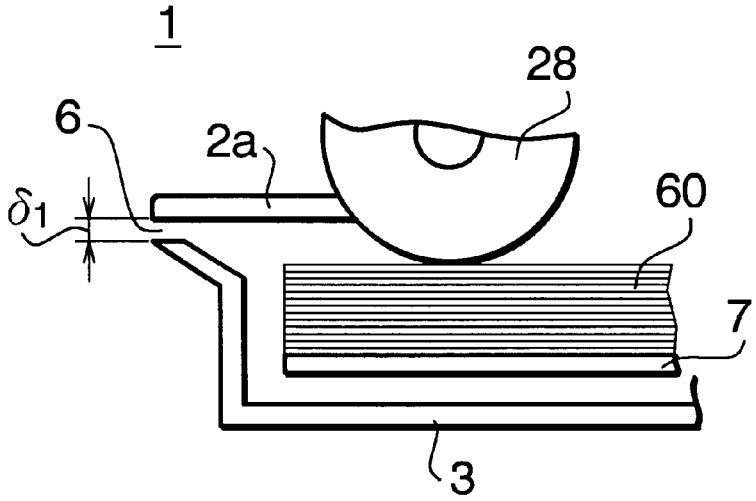
FIG. 14A is a cross sectional view showing the portion in the vicinity of the opening portion of the cartridge in the case of the outer shutter according to the embodiment.
Figure 14B:
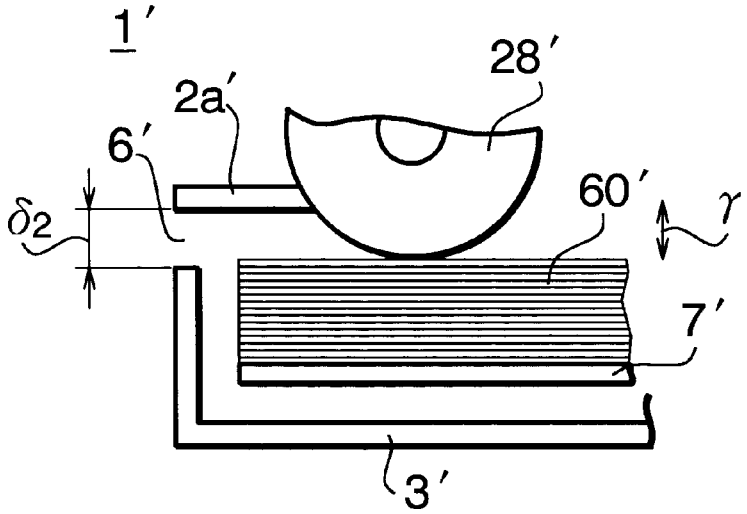
FIG. 14B is a cross sectional view showing the portion in the vicinity of the opening portion of the cartridge in the case of the inner shutter as a comparison.

The provision of the inclined surface 11 in the cartridge can reduce height δ 1 of the slit 6 formed at the top end of the cartridge 1 to be slightly higher than the thickness of the recording paper 60 when the shutter 5 is closed as shown in FIG. 14A. On the other hand, as shown in FIG. 14B, in the general cartridge 1' having no inclined surface, height δ 2 of the slit 6 must be set to a size, which is obtained by adding an amount of entry of the incoming paper feeding roller 28' to the thickness of a piece of paper, to discharge the recording paper 60 smoothly. For this reason, height δ 2 of the slit 6 becomes considerably higher than the thickness of the recording paper 60.

Figure 15:
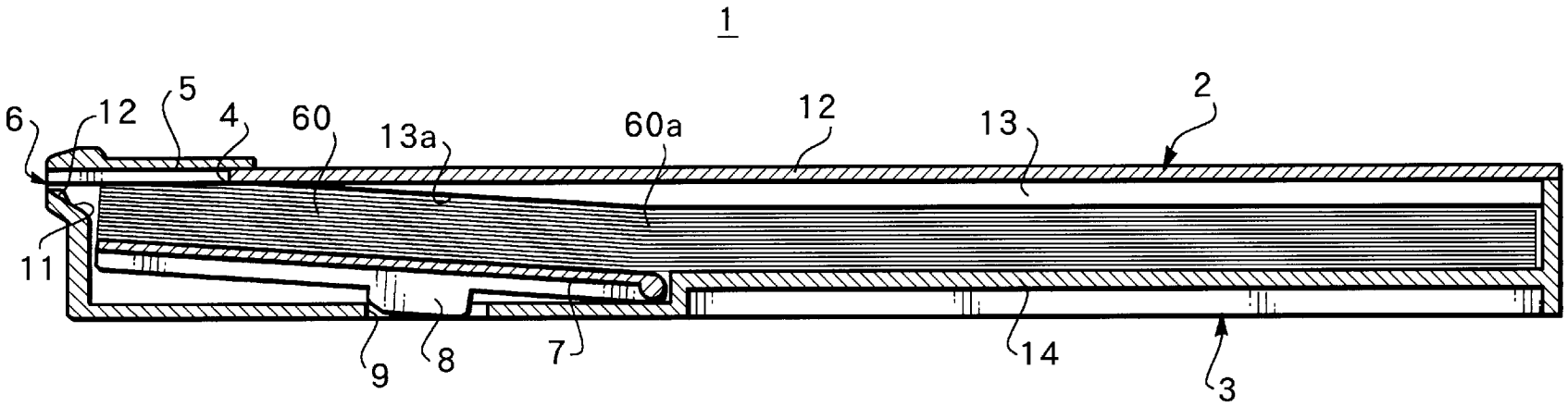
FIG. 15 is a side cross sectional view showing the cartridge according to the embodiment.

Next, the following will explain the structure of the lifter. In the cartridge 1 according to the embodiment, as shown in FIG. 3, the lifter projections 8 are projected on the back portion of the lifter. The opening portion 9 is also formed such that the lifter projections 8 are projected to the back portion of the lower side portion 3. In the state that the cartridge 1 is attached to the printer, the lifter projections 8 are pushed up by the push-up means. Moreover, as shown in FIG. 15, if the cartridge 1 is put into, for example, a package or placed on a plane of a desk or a shelf, the recording paper 60 is lifted since the lifter projections 8 are pushed up. Then, the surface of the first recording paper 60*a* comes in contact with the back surface of the upper side member 2 and the inclined surface 13*a* of the rib 13. At the opening portion 4, the surface of the recording paper 60*a* also comes in contact with the back surface of the upper side member 2. In other words, the plurality of sheets of recording paper 60 is pressed onto the back surface of the upper side member 2 along its stacking direction. This can extremely reduce the space of the cartridge 1. Particularly, since the outer shutter is used as the shutter 5 as mentioned above, there is no need of providing the space for sliding the shutter 5 in the vicinity of the opening portion 4. Therefore, as compared with the case of the inner shutter, a wasteful space of the cartridge 1 can be decreased. Moreover, the formation of the space at the back side of the cartridge can be avoided as much as possible by the rib 13 and the bottom-up portion 14

By the aforementioned structure, the wasteful space of the cartridge 1 is eliminated at both the printer attaching time and the printer non-using time, and the amount of air of the cartridge 1 can be reduced. Also, the recording paper 60 is pressed onto the upper side member 12 such that the recording paper 60 is adhered to each other. As a result, air can be prevented from entering the boundary surface between the recording paper, and the variation in the moisture of the recording paper 60 can be prevented.

Figure 16:
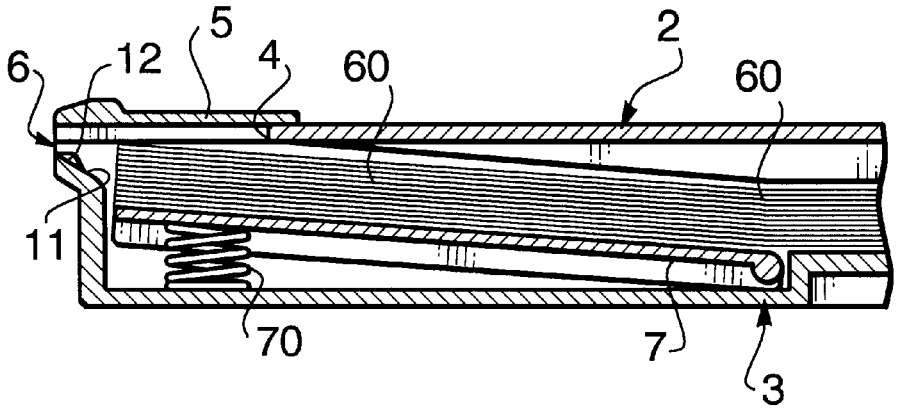
FIG. 16 is a side cross sectional view showing other example of recording paper lifting means of the cartridge according to the embodiment.

As means for lifting the recording paper 60, a spring 70, serving as an elastic member, may be provided between the lifter 7 and the lower side member 3 as shown in FIG. 16. The spring 70 is urged to be pressed in the paper stacking direction by the spring 70. In this case, since there is no need of providing the opening portion 9, the airtightness of the cartridge is high, and the flow of air from the outer section is difficult to occur.

Next, the lifter push-up mechanism will be described.

Figure 17:
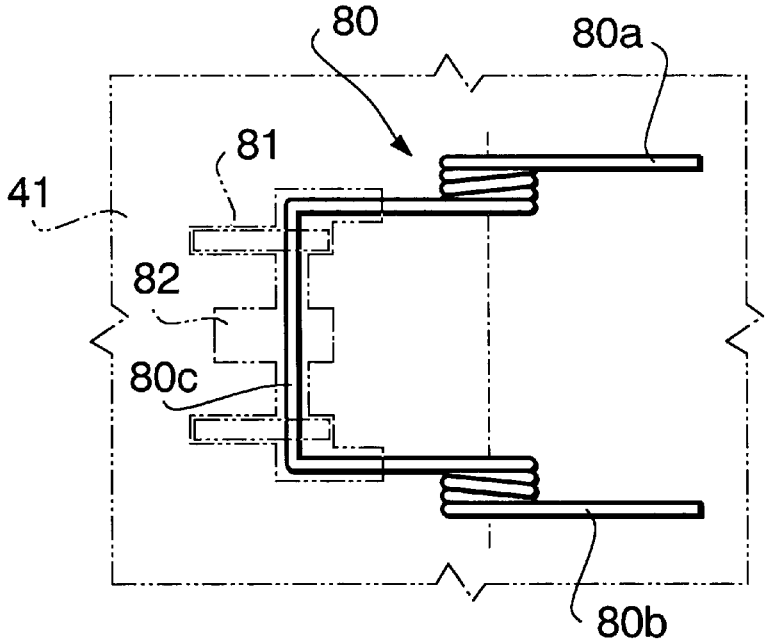
FIG. 17 is a plane view showing a lifter push-up mechanism of the cartridge according to the embodiment.
Figure 18:
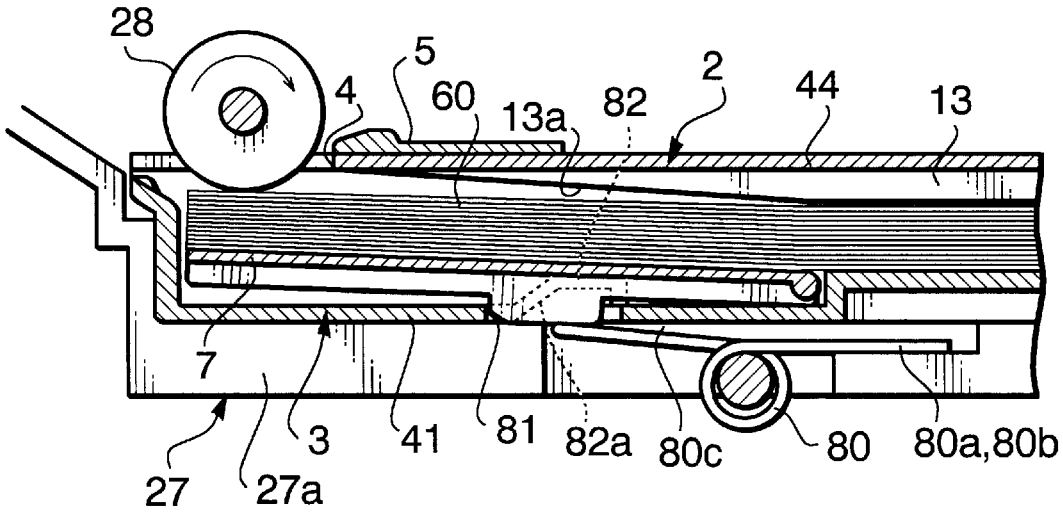
FIG. 18 is a side view showing the lifter push-up mechanism of the cartridge according to the embodiment.
Figure 19:
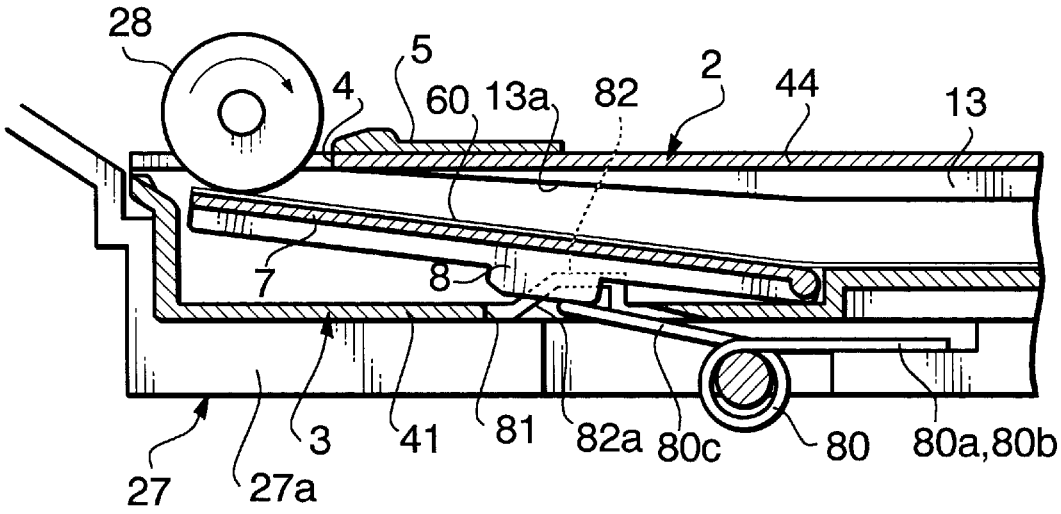
FIG. 19 is a side view showing the lifter push-up mechanism of the cartridge according to the embodiment.

FIGS. 17 and 18 are a plane view and a side view each showing one example of a lifter push-up mechanism when the cartridge having the maximum number of recording paper contained is attached to the printer. FIG. 19 is a side view showing the lifter push-up mechanism of the cartridge according to the embodiment.

A torsion spring 80 is embedded in the bottom plate 27*a* of the cartridge containing section 27. Fixing portions 80*a* and 80*b* of the torsion spring 80 are fixed to the bottom plate 27*a*. When the cartridge 1 is not set, a movable portion 80*c* of the torsion spring 80 slightly projects from the surface of the bottom plate 27*a*, and comes in and out freely by its elasticity.

On the other hand, an opening portion 81 is formed on the bottom plate 41 of the lower side member 3 of the cartridge 1. The lifter projections 8 are loosely fitted to the opening portion 81, and a movable portion 80*c* of the torsion spring 80 passes therethrough. Moreover, a guide concave portion 82 is formed on the bottom plate 41. The guide concave portion 82 has a guide surface 82*a*, which is smoothly inclined along the direction where the cartridge 1 is inserted.

As shown in FIG. 18, if the cartridge 1 containing a large amount of recording paper 60 is inserted, the lifter projections 8 are pushed up by the bottom plate 27*a* of the cartridge containing section 27 so as to lift the recording paper 60. Moreover, the movable portion 80*c* of the torsion spring 80 presses the lifter projections 8 in the upper side direction, and further presses the recording paper 60 onto the paper feeding roller 28. Thereby, the recording paper 60 can be closely contacted to the ceiling plate 44 at the cartridge attaching time. Then, the recording paper 60 is sandwiched between the lifter 7 and the ceiling plate 44. As a result, the flow of air from the outer section to the boundary surface between the recording paper 60 can be reduced, and the variation in the moisture of the recording paper 60 can be controlled.

Also, as shown in FIG. 19, if the cartridge 1 containing a small amount of recording paper 60 is inserted, a movable portion 81*c* of the torsion spring 80 pushes up the lifter 7. As a result, since the recording paper 60 is lifted up to a position where the recording paper 60 and the transferring roller come in contact with each other, the recording paper 60 can be stably supplied up to the last one.

At the time of detaching the cartridge 1, the movable portion 80*c* of the torsion spring 80 can be smoothly moved to the outside of the cartridge 1 along the inclined surface 82*a* of the guide concave portion 82. Therefore, the movable portion 80*c* does not obstruct the detachment of the cartridge 1.

According to the above-explained lifter push-up mechanism, the torsion spring 80 is used as push-up means, so that the linear movable section 80*c* may be put in the cartridge 1 and the area of the opening portion 81 can be extremely reduced. Therefore, the flow of air into the cartridge 1 is decreased, and the variation in the moisture of the cartridge 1 can be controlled.

As explained above, according to the cartridge of the embodiment, first, the area of the opening portion is reduced and the flow of air from the outer section can be prevented. Second, the extra space of the cartridge is reduced, and the amount of inner air can be decreased. Third, the stacked recording paper is maintained to be closely contacted to each other to prevent air from entering the boundary surface between the recording paper. Fourth, the occurrence of overlap-feeding at the paper feeding time can be prevented, the cartridge is stopped in the interior, and the recording paper can be prevented from being exposed to the outer section. This prevents the variation in the moisture of the recording paper in the cartridge. As a result, the variation in the contained-moisture amount of the photofixed-recording medium can be prevented, and high quality of printing can be maintained. Moreover, the conveyance of recording medium in the printer can be improved in connection with not only the photofixed-recording medium but also general recording medium such as PPC paper and recording papers for an ink-jet printer system, a thermal printer system, a thermal melting transfer printer system, a dye sublimation printing system or the like.

Further, since the occurrence of overlap-feeding of the recording medium can be prevented, the print failure of the printer can be prevented. Also, it is possible to avoid the trouble in which the user detaches the cartridge from the printer in a state that the part of recording paper extends off the cartridge so that the recording paper is photosensitized.

As explained above, according to the present invention, the flow of air from the outer section can be reduced, and the variation in the moisture of the internal temperature can be restrained. As a result, the change in the characteristics of the recording medium can be controlled and the quality of print image can be maintained, and the failure of transferring can be prevented.

The present invention is not limited to the above described embodiments, and various variations and modifications may be possible without departing from the scope of the present invention.

This application is based on the Japanese Patent Application No.HEI10-220796 filed on Aug. 4, 1998, entire content of which is expressly incorporated by reference herein.

What is claimed is:

1. A container for containing a recording medium comprising:

a containing body for containing a recording medium;

a first opening portion, formed in said containing body, and having a size permitting the entry of a transferring roller;

a second opening portion, formed in said containing body, through which said recording medium passes; and a shutter, slidably attached to an outside of said containing body, and covering at least said first opening portion.

2. The container according to claim 1, further comprising an inclined surface formed to be continuous to said second opening portion wherein said recording medium passes an upper side of said inclined surface.

3. The container according to claim 2, wherein a contact surface is formed on said inclined surface, said contact surface has an angle of inclination larger than an angle of inclination of said inclined surface, and the recording medium comes in contact with said contact surface.

4. The container according to claim 2, wherein said inclined surface is formed at a position where said inclined surface is covered with said shutter when said shutter is closed.

5. The container according to claim 1, further comprising a pressing device that presses said recording medium onto an inner surface of said containing body.

6. The container according to claim 5, wherein said pressing device comprises a movable plate for supporting said recording medium, projections formed on a back surface of said movable plate, and a third opening portion, formed on said containing body, through which said projections project to an outer section.

7. The container according to claim 5, wherein said pressing device is an elastic member positioned between said movable plate for supporting said recording medium and said containing body.

8. The container according to claim 5, wherein said pressing device comprises a movable plate for supporting said recording medium and a third opening portion for permitting the entry of a coil spring formed in said containing body, wherein the coil spring entering through said third opening portion at an attaching time comes in contact with said movable plate.

9. The container according to claim 1, wherein said recording medium is a photofixed recording medium.

10. A container for containing a recording medium comprising:

a containing body for containing a recording medium; and a pressing device that presses said recording medium onto an inner surface of said containing body at a printing apparatus attaching time and non-attaching time, wherein said pressing device is an elastic member positioned between said movable plate for supporting said recording medium and said containing body.

11. A container for containing a recording medium comprising:

a containing body for containing a recording medium; and a pressing device that presses said recording medium onto an inner surface of said containing body at a printing apparatus attaching time and non-attaching time, wherein said pressing device comprises a movable plate for supporting said recording medium and a third opening portion for permitting the entry of a coil spring formed in said containing body, wherein the coil spring entering through said third opening portion at an attaching time comes in contact with said movable plate.

12. A container for containing a recording medium comprising:

a containing body for containing a recording medium; and a pressing device that presses said recording medium onto an inner surface of said containing body at a printing apparatus attaching time and non-attaching time, wherein said recording medium is a photofixed recording medium.

13. The container according to claim 12, wherein said pressing device comprises a movable plate for supporting said recording medium, projections formed on a back surface of said movable plate, and a third opening portion, formed on said containing body, through which said projections project to an outer section.

14. A container for containing a recording medium comprising:

a containing body for containing a recording medium;

an opening portion, formed on said containing body, through which said recording medium passes;

an inclined surface formed to be continuous with said opening portion; and a contact surface formed on said inclined surface, having an angle of inclination larger than an angle of inclination of said inclined surface, wherein said recording medium comes in contact with said contact surface.

15. The container according to claim 14, wherein said recording medium is a photofixed recording medium.

* * * * *